US009579898B2

(12) United States Patent
Ochi et al.

(10) Patent No.: US 9,579,898 B2
(45) Date of Patent: Feb. 28, 2017

(54) INKJET PRINTER

(71) Applicant: MIMAKI ENGINEERING CO., LTD., Nagano (JP)

(72) Inventors: Kazuhiro Ochi, Nagano (JP); Atsushi Tsuchiya, Nagano (JP)

(73) Assignee: MIMAKI ENGINEERING CO., LTD., Nagano (JP)

( * ) Notice: Subject to any disclaimer, the term of this patent is extended or adjusted under 35 U.S.C. 154(b) by 0 days.

(21) Appl. No.: 14/639,990

(22) Filed: Mar. 5, 2015

(65) Prior Publication Data

US 2015/0251454 A1 Sep. 10, 2015

(30) Foreign Application Priority Data

Mar. 10, 2014 (JP) ..... 2014-046963

(51) Int. Cl.

| | |
|---|---|
| ***B41J 2/17*** | (2006.01) |
| ***B41J 2/175*** | (2006.01) |
| ***B41J 2/18*** | (2006.01) |
| ***B41J 2/14*** | (2006.01) |
| ***B41J 2/15*** | (2006.01) |
| ***B41J 29/38*** | (2006.01) |

(52) U.S. Cl.

CPC ..... *B41J 2/1707* (2013.01); *B41J 2/1433* (2013.01); *B41J 2/15* (2013.01); *B41J 2/175* (2013.01); *B41J 2/18* (2013.01); *B41J 29/38* (2013.01); *B41J 2002/14362* (2013.01); *B41J 2202/08* (2013.01); *B41J 2202/11* (2013.01); *B41J 2202/20* (2013.01)

(58) Field of Classification Search

CPC ..... B41J 2/135; B41J 2/1707; B41J 2202/08
See application file for complete search history.

(56) References Cited

U.S. PATENT DOCUMENTS

| | | | | |
|---|---|---|---|---|
| 2008/0198212 | A1* | 8/2008 | Ikeda et al. | 347/92 |
| 2008/0204533 | A1* | 8/2008 | Nathan | B41J 2/14 347/89 |
| 2009/0002408 | A1* | 1/2009 | Azami | B41J 2/04563 347/6 |
| 2013/0271529 | A1* | 10/2013 | Domae et al. | 347/47 |

FOREIGN PATENT DOCUMENTS

| | | |
|---|---|---|
| CN | 103317850 | 9/2013 |
| JP | 2012-051160 | 3/2012 |

OTHER PUBLICATIONS

"Office Action of China Counterpart Application" with English translation, issued on Jan. 29, 2016, p. 1-p. 12, in which the listed reference was cited.
"Office Action of China Counterpart Application" with English translation thereof, issued on Sep. 19, 2016, p. 1-14.

* cited by examiner

*Primary Examiner* — Kristal Feggins
*Assistant Examiner* — Kendrick Liu
(74) *Attorney, Agent, or Firm* — Jianq Chyun IP Office

(57) ABSTRACT

An inkjet printer that can improve image quality of printing than in a conventional technique is to be provided. An inkjet printer includes an inkjet head 40 that discharges ink droplets toward a print medium; an in-head ink heating unit that heats ink inside the inkjet head 40; and an out-of-head ink heating device 68 that heats ink in an ink supply passage to the inkjet head 40 at outside of the inkjet head 40, and the out-of-head ink heating device 68 is arranged at a position where the heated ink is supplied to the inkjet head 40.

6 Claims, 11 Drawing Sheets

INKJET PRINTER

CROSS REFERENCE TO RELATED APPLICATIONS

This application claims the priority benefit of Japan application serial no. 2014-046963, filed on Mar. 10, 2014. The entirety of the above-mentioned patent application is hereby incorporated by reference herein and made a part of this specification.

TECHNICAL FIELD

The present disclosure relates to an inkjet printer that performs printing on a print medium.

DESCRIPTION OF THE BACKGROUND ART

Conventionally, an inkjet printer that includes an inkjet head in which a plurality of nozzles for discharging ink droplets onto a print medium is known (see JP 2012-51160 A).

As ink used by an inkjet printer, there are ones with too much viscosity at normal temperature to be discharged from nozzles. Due to this, among conventional inkjet printers, there are ones having an inkjet head provided with a heater for heating ink for a purpose of reducing the viscosity of the ink, so that the ink can appropriately be discharged from the nozzles.

However, in the conventional inkjet printer that heats the ink by the heater in the inkjet head, since the ink that has already been present inside the inkjet head and heated by the heater is cooled by the ink supplied from the outside of the inkjet head at a portion where the ink is supplied from the outside to the inside within the inkjet head and in a vicinity thereof, unevenness in temperature is generated in the ink inside the inkjet head depending on locations. The unevenness in temperature being generated in the ink inside the inkjet head depending on the locations means that unevenness in viscosity is generated in the ink inside the inkjet head depending on the locations. When the unevenness in viscosity is generated in the ink inside the inkjet head depending on the locations, an ink droplet discharging accuracy is varied for each of the nozzles of the inkjet head by the unevenness in viscosity of the ink inside the inkjet head. Accordingly, in the conventional inkjet printer that heats the ink by the heater in the inkjet head, there is a problem that an image quality of printing is degraded.

SUMMARY

Thus, the present disclosure aims to provide an inkjet printer that can improve the image quality of printing than in the conventional technique.

An inkjet printer of the present disclosure is characteristic in including an inkjet head that discharges ink droplets toward a print medium; an in-head ink heating unit that heats ink inside the inkjet head; and an out-of-head ink heating device that heats ink in an ink supply passage to the inkjet head at outside of the inkjet head, wherein the out-of-head ink heating device is arranged at a position where the heated ink is supplied to the inkjet head.

According to this configuration, in the inkjet printer of the present invention, since the ink heated by the out-of-head ink heating device is supplied to the inkjet head, the ink that has already been present inside the inkjet head and heated by the heater can be prevented from having its temperature changed by the ink supplied from the outside of the inkjet head at a portion where the ink is supplied from the outside to the inside of the inkjet head and in a vicinity thereof. As a result, since the inkjet printer of the present disclosure can suppress generation of unevenness in temperature in the ink inside the inkjet head depending on locations, generation of unevenness in viscosity in the ink inside the inkjet head depending on locations can be suppressed. Being able to suppress the generation of unevenness in viscosity in the ink inside the inkjet head depending on the locations means that ink droplet discharging accuracy for each of the nozzles of the inkjet head becoming different due to the unevenness in viscosity in the ink inside the inkjet head can be suppressed. Accordingly, the inkjet printer of the present disclosure can improve image quality of printing than in conventional techniques.

Further, in the inkjet printer of the present disclosure, the out-of-head ink heating device may include a former heating unit that heats ink, and a latter heating unit arranged on the supply passage at a position to heat ink between the former heating unit and the inkjet head, wherein the former heating unit may heat the ink at a higher temperature than the latter heating unit.

According to this configuration, in the inkjet printer of the present disclosure, since the former heating unit heats the ink at a higher temperature than the latter heating unit, a length of the former heating unit along the ink supply passage to the inkjet head can be made shorter in the case of heating the ink to a particular temperature by using the entire out-of-head ink heating device, as compared to a configuration in which the former heating unit heats the ink at a same temperature as the latter heating unit. Accordingly, the inkjet printer of the present disclosure can make the out-of-head ink heating device more compact, as compared to the configuration in which the former heating unit heats the ink at the same temperature as the latter heating unit.

Further, the inkjet printer of the present disclosure may include a connector for dividing the supply passage between the former heating unit and the latter heating unit, and the out-of-head ink heating device may be configured with the former heating unit and the latter heating unit being different components.

According to this configuration, in the inkjet printer of the present disclosure, the former heating unit and the latter heating unit are configured as different components, and the supply passage is divided by the connector arranged between the former heating unit and the latter heating unit; thus, replacement of the inkjet head can be performed easily.

Further, in the inkjet printer of the present disclosure, the inkjet head may have formed therein a plurality of nozzle rows in which nozzles that discharge ink droplets are aligned in plurality, and the inkjet head may include an ink supplying portion for the ink heated by the out-of-head ink heating device to be supplied for each of the nozzle rows, the plurality of nozzle rows may be arranged in a direction vertically intersecting an extending direction of the nozzle rows, and the plurality of ink supplying portions of the inkjet head may include ones arranged on different sides in the extending direction with respect to the nozzle rows.

According to this configuration, in the inkjet printer of the present disclosure, as compared to a configuration in which all of the ink supplying portions of the inkjet head is arranged on a same side in the extending direction of the nozzle rows with respect to the nozzle rows, since the locations within the inkjet head where the ink heated by the out-of-head ink heating device is to be supplied can be dispersed within the inkjet head, the generation of the unevenness in temperature in the ink inside the inkjet head depending on the locations can be prevented. Accordingly, the inkjet printer of the present disclosure can improve the image quality of printing.

Further, in the inkjet printer of the present disclosure, the ink supplying portions that supply the ink to the nozzle rows that are adjacent to each other may be arranged on different sides from each other in the extending direction with respect to the nozzle rows.

According to this configuration, in the inkjet printer of the present disclosure, since the locations within the inkjet head where the ink heated by the out-of-head ink heating device is to be supplied can be dispersed finely in the inkjet head, the generation of the unevenness in temperature in the ink inside the inkjet head depending on the locations can be prevented. Accordingly, the inkjet printer of the present disclosure can improve the image quality of printing.

The inkjet printer of the present disclosure can improve the image quality of printing than in the conventional technique.

DETAILED DESCRIPTION OF PREFERRED EMBODIMENTS

Hereinbelow, embodiments of the present disclosure will be described with reference to the drawings.

First Embodiment

Firstly, a configuration of an inkjet printer according to a first embodiment of the present disclosure will be described.

Figure 1:
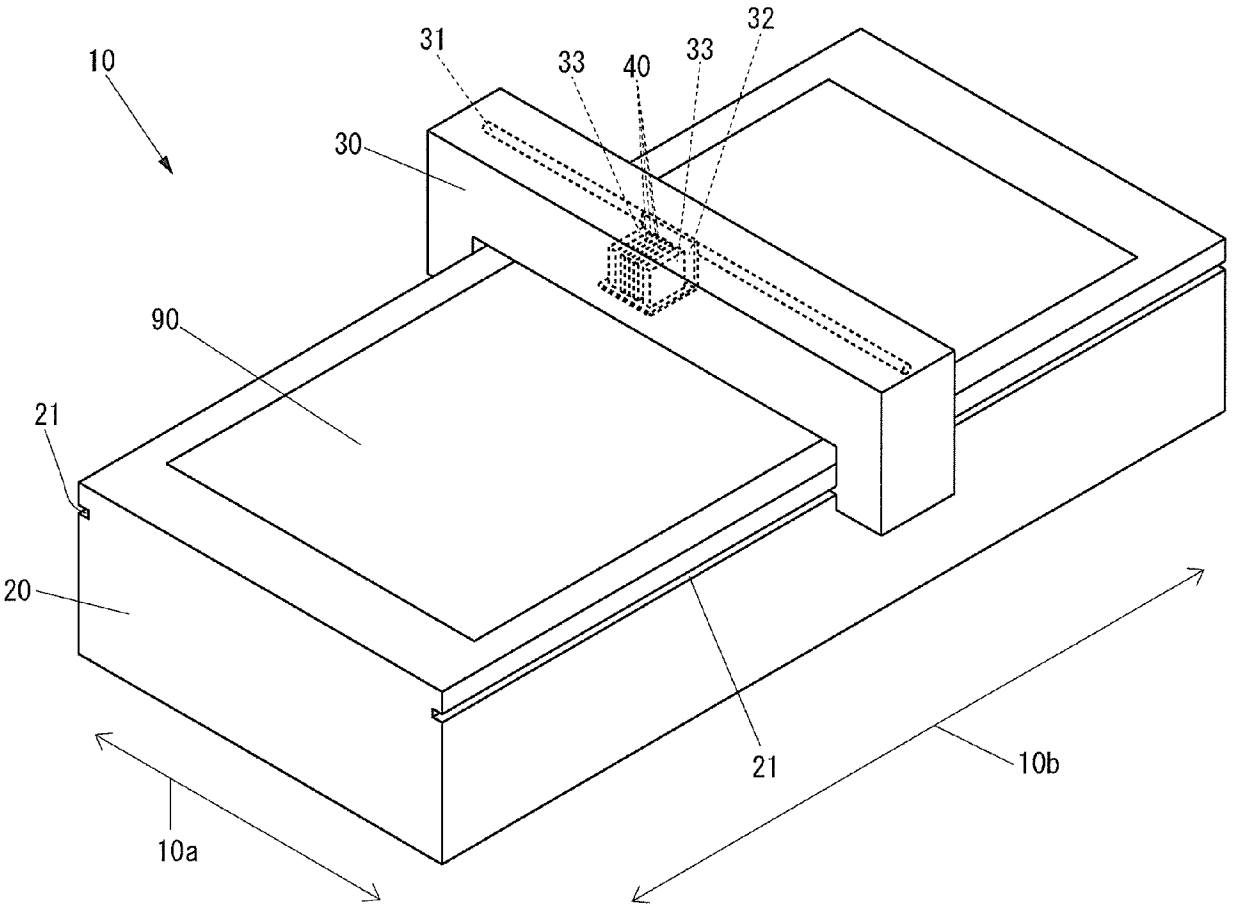
FIG. 1 is a perspective view of an external appearance of an inkjet printer according to a first embodiment of the present disclosure.

FIG. 1 is a perspective view of an outer appearance of an inkjet printer 10 according to the present embodiment.

As shown in FIG. 1, the inkjet printer 10 includes a medium mounting unit 20 on which a print medium 90 is mounted, and a main body 30 extending in a main scanning direction shown by an arrow 10*a*.

The medium mounting unit 20 has rails 21, which extend in a sub scanning direction shown by the arrow 10*b* vertically intersecting the main scanning direction shown by the arrow 10*a*, and movably support the main body 30 in the sub scanning direction, at its both ends in the main scanning direction.

The main body 30 includes a guide rail 31 extending in the main scanning direction shown by the arrow 10*a*, a carriage 32 supported on the guide rail 31 so as to be movable in the main scanning direction, an ultraviolet irradiating device 33 mounted on the carriage 32 and delivers ultraviolet rays onto an ultraviolet curing type of ink on the print medium 90, and a plurality of inkjet heads 40 mounted on the carriage 32 and discharges ink droplets of the ultraviolet curing type of ink toward the print medium 90.

The plurality of inkjet heads 40 is each configured such that an arbitrary type of ink, such as Cyan ink, Magenta ink, Yellow ink, Black ink, White ink, Clear ink, and the like, is supplied from a tank (not shown) outside the inkjet head 40.

Figure 2:
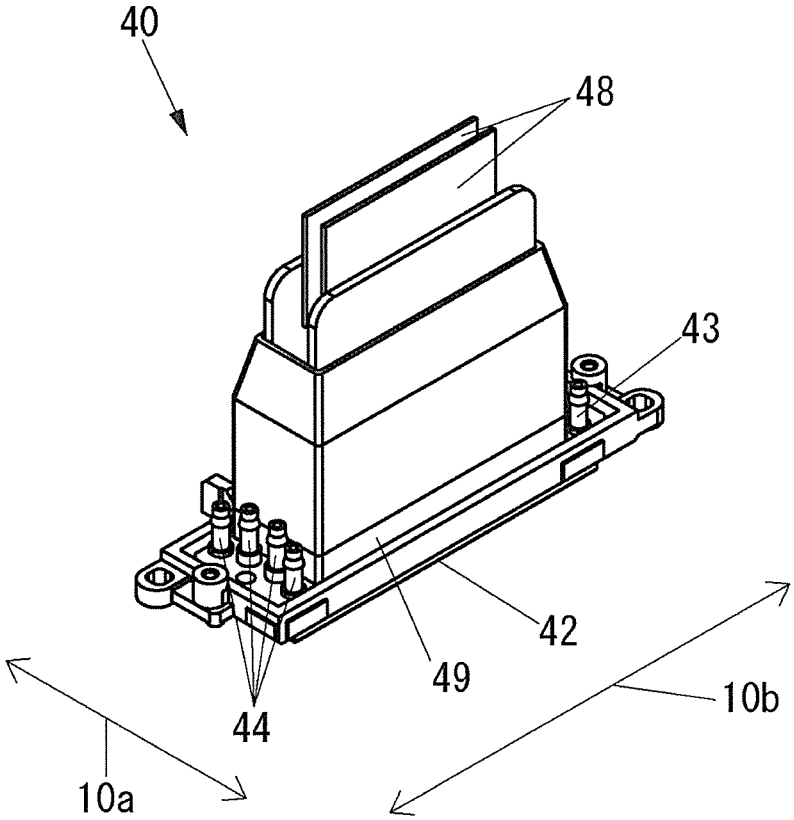
FIG. 2 is a perspective view of an inkjet head shown in FIG. 1.
Figure 3:
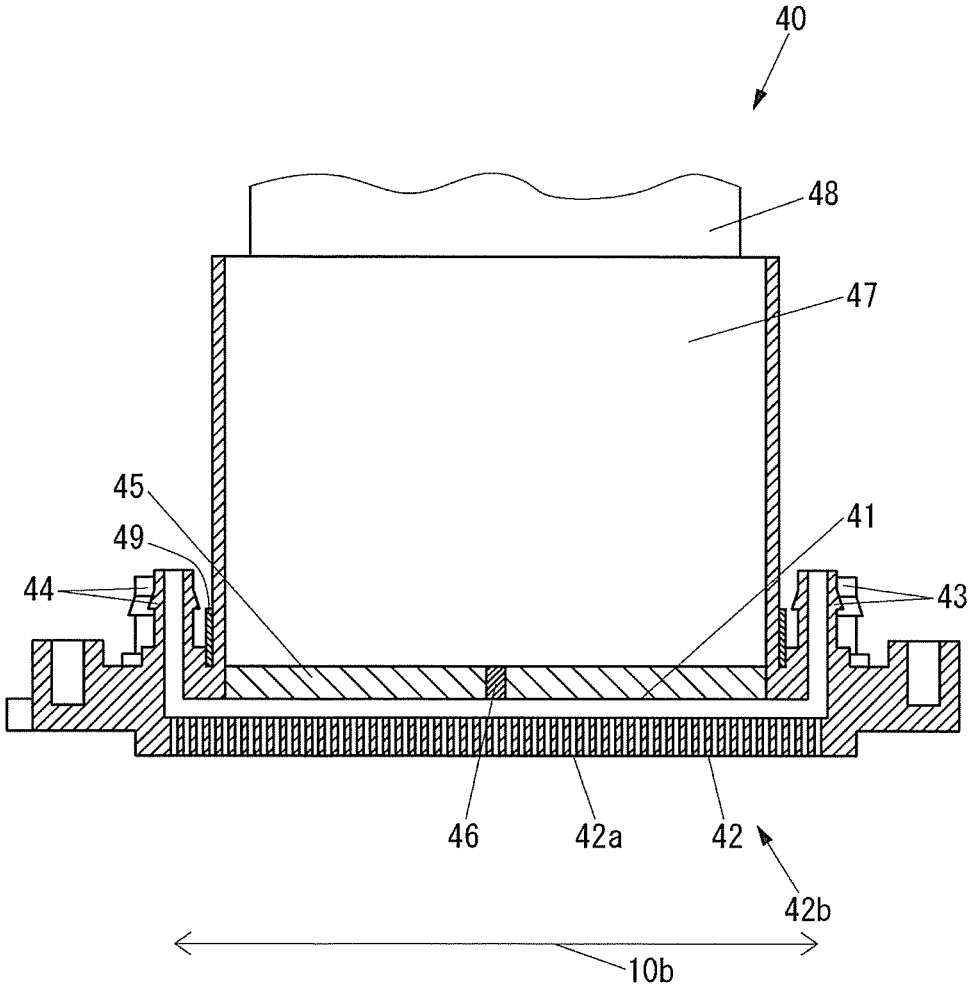
FIG. 3 is a schematic sectional side view of the inkjet head shown in FIG. 1.

FIG. 2 is a perspective view of an inkjet head 40. FIG. 3 is a schematic sectional side view of the inkjet head 40.

As shown in FIG. 2 and FIG. 3, the inkjet head 40 has formed thereon four ink passages 41 for flowing the ink (in FIG. 3, only one of them is shown in connection to the cross section thereof), and a nozzle surface 42 in which four rows (hereafter referred to as "nozzle rows") 42*b* formed by a plurality of nozzles 42*a* for discharging the ink droplets arranged in plurality in the sub scanning direction shown by the arrow 10*b* are arranged in parallel in the main scanning direction shown by the arrow 10*a* (in FIG. 3, only one of them is shown in connection to the cross section thereof). The inkjet head 40 includes four ink supplying portions 43 for the ink to be supplied from a tank (not shown) outside the inkjet head 40 to the ink passages 41 (in FIG. 2, only one of them is shown due to the viewpoint thereof. Further, in FIG. 3, only two of them are shown in connection to the cross section thereof), four ink ejecting portions 44 for ejecting the ink to the outside of the inkjet head 40 form the ink passages 41, a metal plate 45 such as stainless steel configuring a part of the ink passages 41, a temperature sensor 46 arranged at substantially a center of the plate 45 in a sub scanning direction for detecting a temperature of the ink in the ink passages 41, a drive unit 47 that drives a discharging device (not shown) for discharging the ink droplets from each of the plurality of nozzles 42*a*, and flexible cables 48 that transmits signals from the temperature sensor 46 to the outside of the inkjet heads 40 and signals from the outside of the inkjet heads 40 to the drive unit 47.

The ink passage 41, the nozzle row 42*b*, the ink supplying portion 43, and the ink ejecting portion 44 are communicated with each other. That is, the inkjet head 40 includes a total of four sets of the ink passage 41, the nozzle row 42*b*, the ink supplying portion 43, and the ink ejecting portion 44.

The four ink supplying portions 43 may be configured to supply the same type of ink from the tank (not shown) outside the inkjet head 40, or may be configured to supply different types of ink supplied from the tank (not shown) outside the inkjet head 40, respectively.

The inkjet head 40 has a film-shaped heater 49 wrapped around its outer periphery. The heater 49 configures an in-head ink heating unit for heating the ink inside the inkjet head 40, that is, the ink in the ink passages 41.

Figure 4:
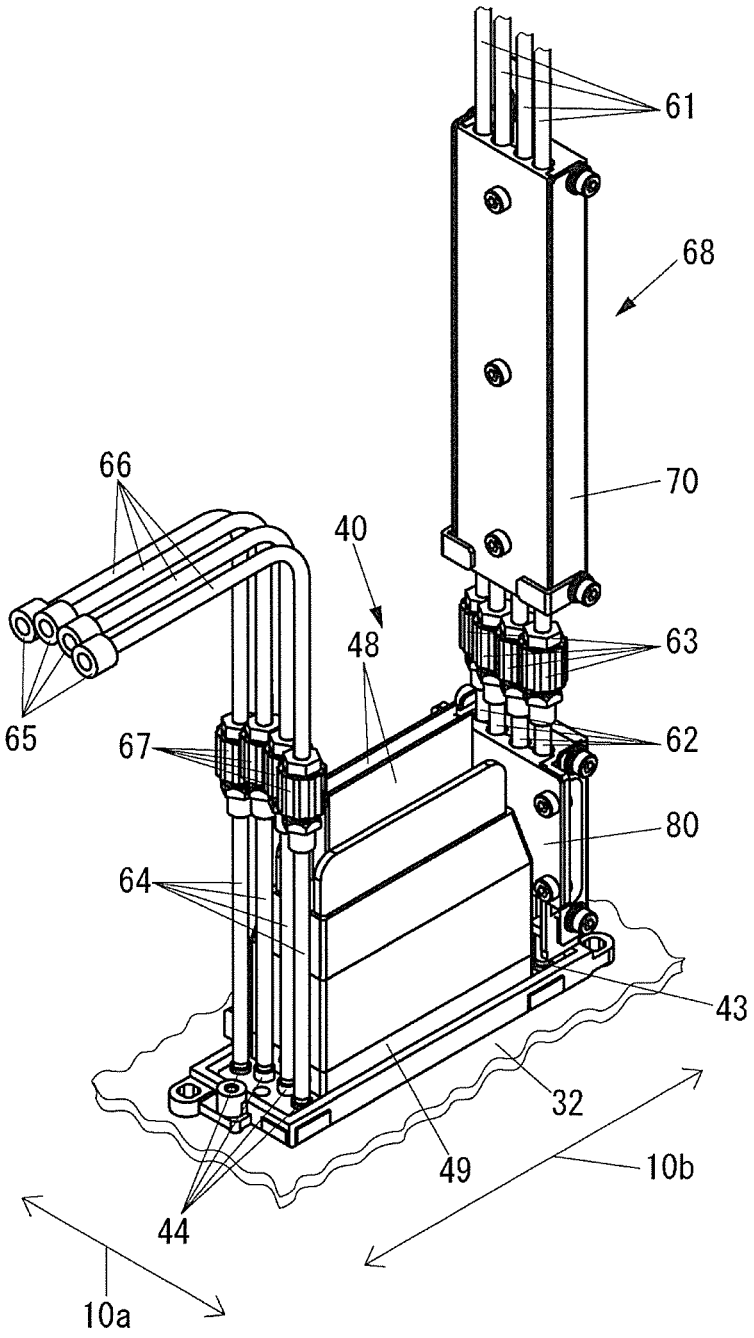
FIG. 4 is a perspective view of a vicinity of the inkjet head in a state where the inkjet head shown in FIG. 1 is mounted on a carriage.

FIG. 4 is a perspective view of a vicinity of the inkjet head 40 in a state where the inkjet head 40 is mounted on the carriage 32.

As shown in FIG. 4, the inkjet head 40 is fixed to the carriage 32 in a state where a portion where the nozzle surface 42 (see FIG. 2) is formed is inserted into a through hole (not shown) of the carriage 32.

The inkjet printer 10 (see FIG. 1) includes tubes 61 communicating with the tank (not shown) outside the inkjet head 40, tubes 62 communicating with the ink supplying portions 43, connectors 63 connecting the tubes 61 and the tubes 62, tubes 64 communicating with the ink ejecting portions 44, shutoff members 65 that are capable of opening and closing, tubes 66 communicating with the shutoff members 65, connectors 67 connecting the tubes 64 and the tubes 66, and an out-of-head ink heating device 68 that heats the ink in ink supply passage to the inkjet head 40 on the outside of the inkjet head 40.

The tubes 61, the tubes 62, and the connectors 63 form the ink supply passage to the inkjet head 40.

The out-of-head ink heating device 68 is arranged at a position where the heated ink is supplied to the inkjet head 40.

The out-of-head ink heating device 68 includes a heating block 70 as a former heating unit attached to the tubes 61 for heating the ink in the tubes 61, and a heating block 80 as a latter heating unit attached to the tubes 62 for heating the ink in the tubes 62. The heating block 80 is arranged in the ink supply passage to the inkjet head 40, at a position to heat the ink between the heating block 70 and the inkjet head 40. The heating block 70 serves a role to heat the unheated ink. On the other hand, the heating block 80 primarily serves a temperature keeping role to maintain the temperature of the ink heated by the heating block 70.

The connectors 63 for dividing the ink supply passage to the inkjet head 40 are arranged between the heating block 70 and the heating block 80.

Figure 5:
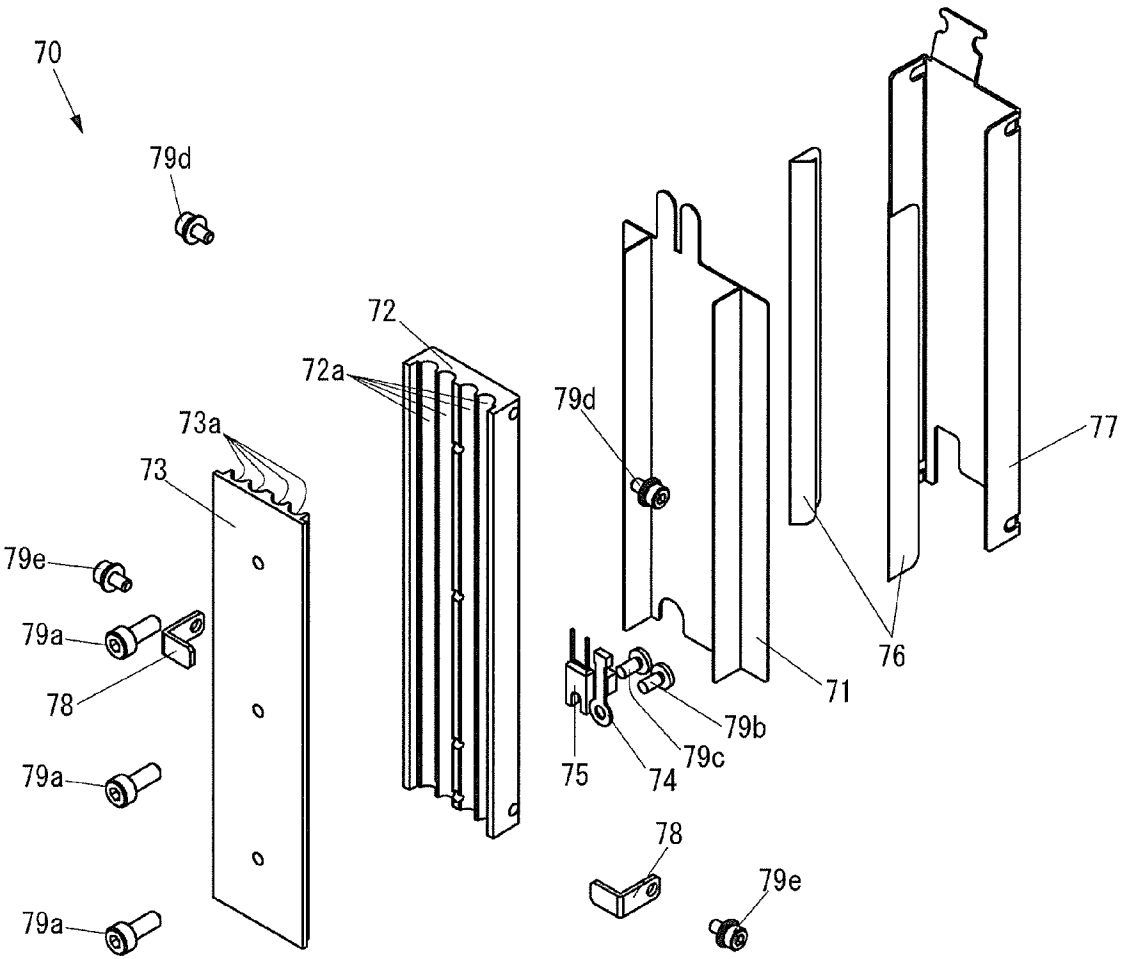
FIG. 5 is an exploded perspective view of a heating block shown in FIG. 4.

FIG. 5 is an exploded perspective view of the heating block 70.

As shown in FIG. 5, the heating block 70 includes a heater 71 for heating the ink in the tubes 61 (see FIG. 4), a heater base 72 in which grooves 72*a* for the tubes 61 to fit in are formed and that for example is formed of aluminum and heated by the heater 71, a heater base 73 in which grooves 73*a* for the tubes 61 to fit in are formed, and that is used for fixing the tubes 61 by sandwiching them with the heater base 72 and for example is formed of aluminum, a temperature sensor 74 for indirectly detecting the temperature of the ink in the tubes 61 by detecting a temperature of the heater base 72, a temperature fuse 75 making contact with the heater base 72, protective films 76 that protect the heater 71, a presser plate 77 for fixing the heater 71 to the heater base 72, a heater base retaining plate 78 for fixing the heater base 73 to the heater base 72, screws 79*a* for fixing the heater base 72 and the heater base 73, a screw 79*b* for fixing the heater base 72 and the temperature sensor 74, a screw 79*c* for fixing the heater base 72 and the temperature fuse 75, screws 79*d* for fixing the heater base 72 and the presser plate 77, and screws 79*e* for fixing the heater base 72, the presser plate 77, and the heater base retaining plate 78.

Figure 6:
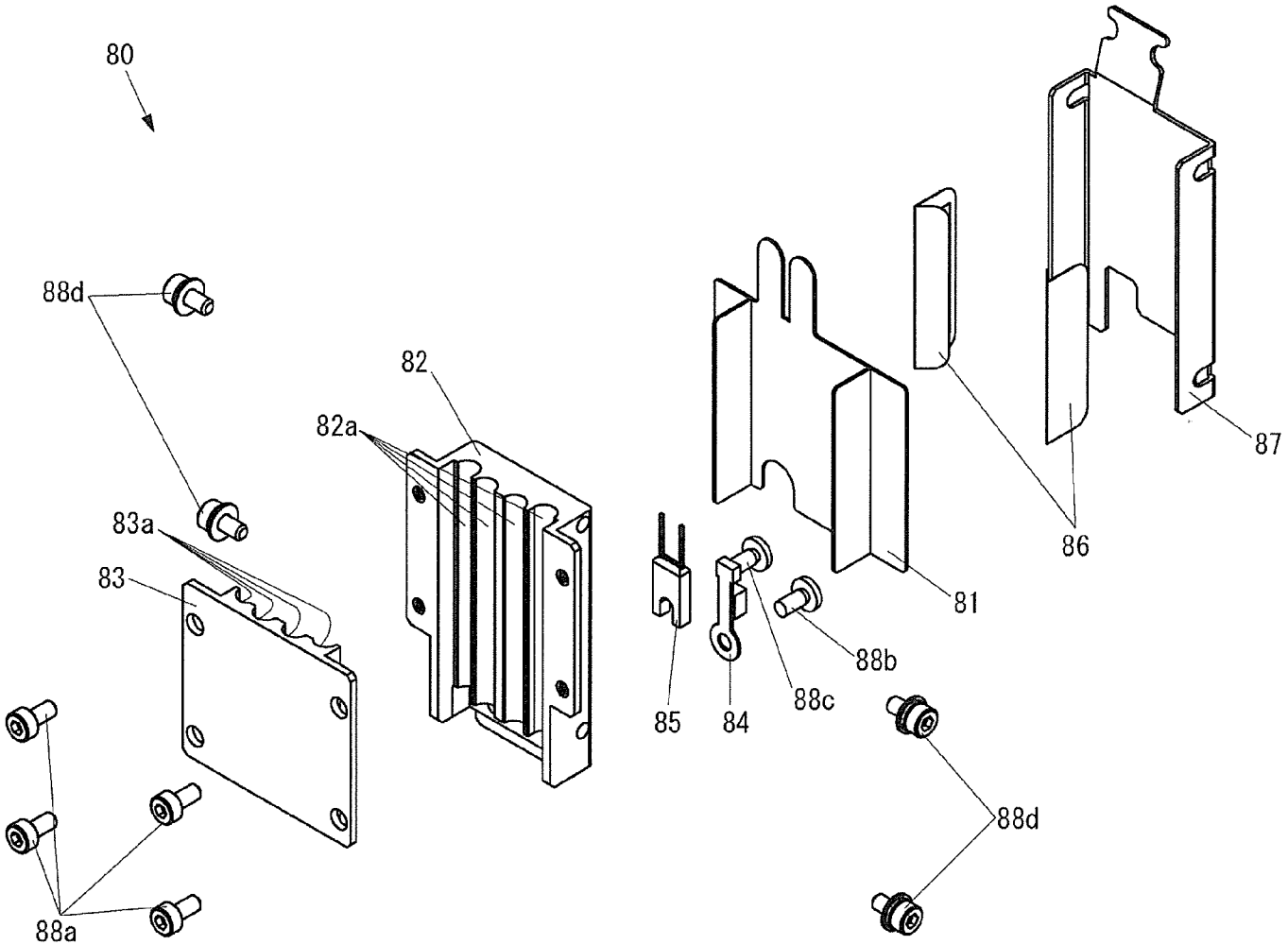
FIG. 6 is an exploded perspective view of a heating block shown in FIG. 4, which is different from the heating block shown in FIG. 5.

FIG. 6 is an exploded perspective view of the heating block 80.

As shown in FIG. 6, the heating block 80 includes a heater 81 for heating the ink in the tubes 62 (see FIG. 4), a heater base 82 in which grooves 82*a* for the tubes 62 to fit in are formed and that for example is formed of aluminum and heated by the heater 81, a heater base 83 in which grooves 83*a* for the tubes 62 to fit in are formed, and that is used for fixing the tubes 62 by sandwiching them with the heater base 82 and for example is formed of aluminum, a temperature sensor 84 for indirectly detecting the temperature of the ink in the tubes 62 by detecting a temperature of the heater base 82, a temperature fuse 85 making contact with the heater base 82, protective films 86 that protect the heater 81, a presser plate 87 for fixing the heater 81 to the heater base 82, screws 88*a* for fixing the heater base 82 and the heater base 83, a screw 88*b* for fixing the heater base 82 and the temperature sensor 84, a screw 88*c* for fixing the heater base 82 and the temperature fuse 85, and screws 88*d* for fixing the heater base 82 and the presser plate 87.

Figure 7:
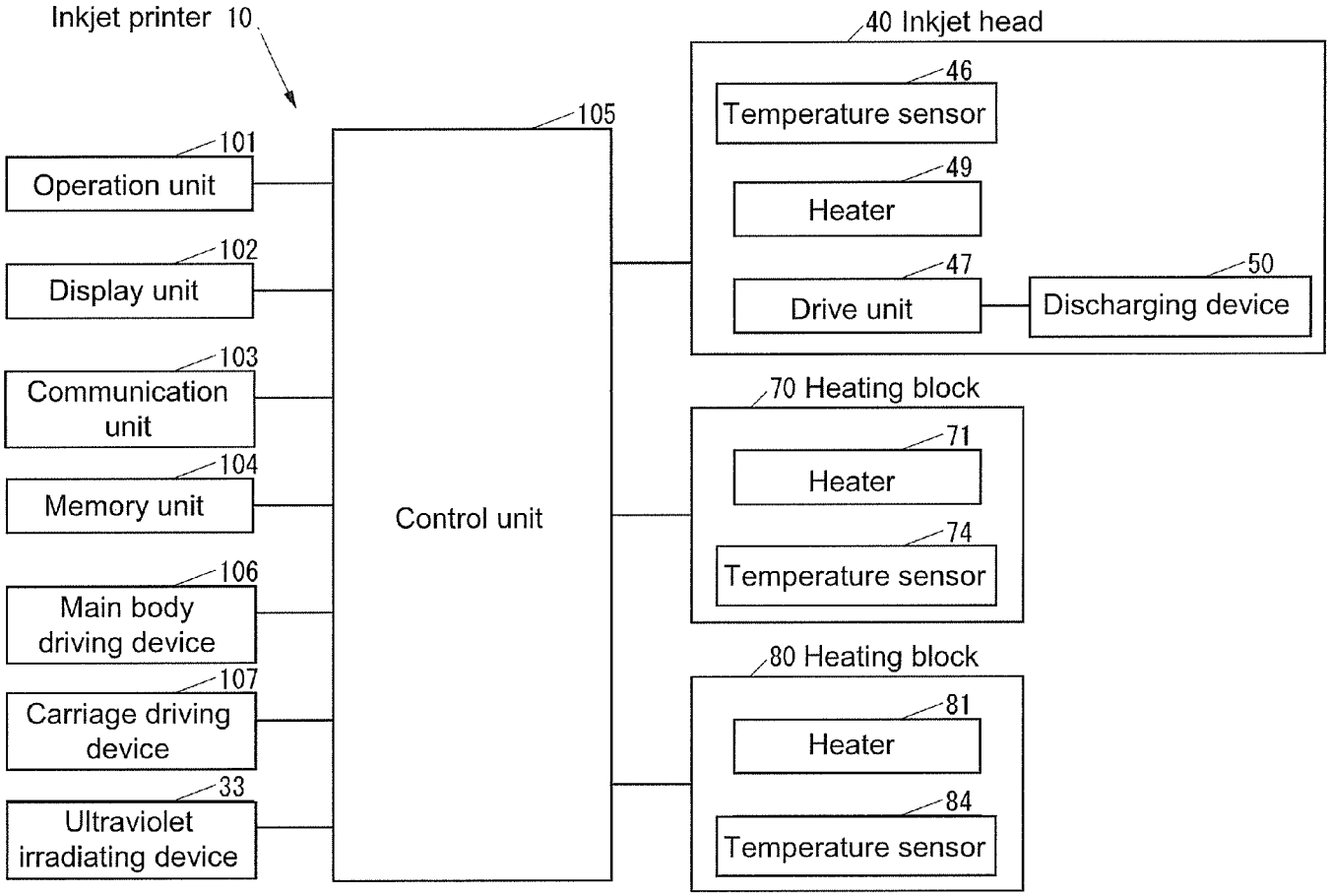
FIG. 7 is a block diagram of the inkjet printer shown in FIG. 1.

FIG. 7 is a block diagram of the inkjet printer 10.

As shown in FIG. 7, the inkjet printer 10 includes an operation unit 101 that is an input device such as a button with which various operations are inputted, a display unit 102 that is a display device such as an LCD (Liquid Crystal Display) for displaying various types of information, a communication unit 103 that is a communication device for performing communication with an external device such as a PC (Personal Computer), a memory unit 104 that is a memory device such as an EEPROM (Electrically Erasable Programmable Read Only Memory) for storing various types of data, a control unit 105 that controls an entirety of the inkjet printer 10, a main body driving device 106 for moving the main body 30 (see FIG. 1) along the rails 21 (see FIG. 1) in the sub scanning direction shown by an arrow 10*b* (see FIG. 1), and a carriage driving device 107 for moving the carriage 32 (see FIG. 1) along the guide rail 31 (see FIG. 1) in the main scanning direction shown by an arrow 10*a* (see FIG. 1), as well as the aforementioned ultraviolet irradiating device 33, inkjet heads 40, heating block 70, and heating block 80.

The control unit 105 includes, for example, a CPU (Central Processing Unit), a ROM (Read Only Memory) that stores program and various types of data in advance, and a RAM (Random Access Memory) that is used as a working area for the CPU. The CPU is configured to execute the program stored in the ROM or the memory unit 104.

The inkjet head 40 includes a discharging device 50 as an aforementioned discharging device.

Next, detachment and attachment of the inkjet head 40 will be described.

The inkjet head 40 can be detached from the inkjet printer 10 by having the tubes 61 and the tubes 62 separated by the connectors 63, the tubes 64 and the tubes 66 separated by the connectors 67, and being detached from the carriage 32.

Further, the inkjet head 40 can be attached to the inkjet printer 10 by having the tubes 61 and the tubes 62 connected by the connectors 63, the tubes 64 and the tubes 66 connected by the connectors 67, and being attached to the carriage 32.

It should be noted that, in case that the inkjet head 40 is replaced, the heating block 80 is detached from the tubes 62 of the old inkjet head 40 to be replaced, and can be attached to the tubes 62 of the new inkjet head 40 to replace.

Next, filling of ink to the inkjet head 40 will be described.

When ink is filled in the ink passages 41 in the inkjet head 40, when the ink ejected through the ink ejecting portions 44 from the ink passages 41 is ejected from the shutoff members 65 after the ink has been supplied through the ink supplying portions 43 from the tank in a state where the shutoff members 65 are opened, the shutoff members 65 are closed and the ink supply from the tank through the ink supplying portions 43 is stopped. When air bubbles enter into the ink in the ink passages 41 in the inkjet head 40, the ink droplet discharging accuracy is deteriorated due to an appropriate pressure not being applied to the ink by the discharging device 50, however, by the ink being filled in the ink passages 41 as above, the air bubbles can be prevented from entering into the ink in the ink passages 41.

Next, an operation of the inkjet printer 10 will be described.

When print data sent from outside is received through the communication unit 103, the control unit 105 of the inkjet printer 10 controls the ultraviolet irradiating device 33, the inkjet heads 40, the main body driving device 106, and the carriage driving device 107 based on this print data to perform printing by the inkjet heads 40.

Specifically, the control unit 105 controls the carriage driving device 107 to move the carriage 32 along the guide rail 31 in the main scanning direction shown by the arrow 10*a*, so that the ultraviolet irradiating device 33 and the inkjet heads 40 mounted on the carriage 32 are moved in the main scanning direction with respect to the print medium 90. At this occasion, the control unit 105 causes the ink to adhere to the print medium 90 by discharging the ink toward the print medium 90 by the discharging device 50 of the inkjet heads 40 by controlling the drive unit 47 of the inkjet heads 40, and cures the ink on the print medium 90 by delivering ultraviolet rays toward the ink on the print medium 90 by the ultraviolet irradiating device 33. That is, the control unit 105 performs printing with ink in the main scanning direction. Further, each time the printing in the main scanning direction is completed, the control unit 105 moves the main body 30 along the rails 21 in the sub scanning direction shown by the arrow 10*b* by controlling the main body driving device 106 so that the ultraviolet irradiating device 33 and the inkjet heads 40 mounted on the main body 30 via the carriage 32 are moved relatively in the sub scanning direction with respect to the print medium 90 to perform printing again in the main scanning direction at a subsequent printing position in the sub scanning direction.

In case of performing printing by the inkjet heads 40, the control unit 105 controls the inkjet heads 40, the heating block 70, and the heating block 80 to heat the ink to be discharged from the inkjet heads 40.

Specifically, the control unit 105 controls the heater 71 of the heating block 70 to make the temperature of the heater base 72 detected by the temperature sensor 74 of the heating block 70 at a predetermined temperature, so that the temperature of the ink in the tubes 61 becomes 55° C. Further, the control unit 105 controls the heater 81 of the heating block 80 to make the temperature of the heater base 82 detected by the temperature sensor 84 of the heating block 80 at a predetermined temperature, so that the temperature of the ink in the tubes 62 becomes 50° C. Further, the control unit 105 controls the heater 49 of the inkjet head 40 to make the temperature of the ink in the ink passages 41 detected by the temperature sensor 46 of the inkjet head 40 at 50° C., so that the temperature of the ink in the ink passages 41 becomes 50° C.

As described above, the inkjet printer 10 supplies the ink heated by the out-of-head ink heating device 68 to the inkjet heads 40, so the ink that has already been present inside the inkjet heads 40 and heated by the heater 49 can be prevented from having its temperature changed by the ink supplied from the outside the inkjet heads 40 at portions where the ink is supplied from the outside to the insides of the inkjet heads 40, that is, the ink supplying portions 43 and in vicinities of the ink supplying portions 43. As a result, since the inkjet printer 10 can suppress generation of unevenness in temperature in the ink inside the inkjet heads 40 depending on locations, generation of unevenness in viscosity in the ink inside the inkjet heads 40 depending on locations can be suppressed. Being able to suppress the generation of unevenness in viscosity in the ink inside the inkjet head 40 depending on the locations means that ink droplet discharging accuracy for each of the nozzles 42*a* of the inkjet head 40 becoming different due to the unevenness in viscosity in the ink inside the inkjet head 40 can be suppressed. Accordingly, the inkjet printer 10 can improve image quality of printing than in conventional techniques.

It should be noted that, in the present embodiment, in the inkjet heads 40, since the ink is supplied from the outside to the inside thereof at their one end portions in the sub scanning direction shown by the arrow 10*b*, an effect of suppressing the generation of unevenness in viscosity of the ink therein depending on locations by the out-of-head ink heating devices 68 is significant. However, the inkjet heads 40 can achieve the effect of suppressing the generation of unevenness in viscosity of the ink therein depending on locations by the out-of-head ink heating devices 68 even if the ink is configured to be supplied from the outside to the inside thereof at portions other than the one end portions in the sub scanning direction. For example, the effect of suppressing the generation of unevenness in viscosity of the ink therein depending on locations by the out-of-head ink heating devices 68 can be obtained, even when the inkjet heads 40 are configured to have the ink supplied from the outside to the inside thereof at a center in the sub scanning direction.

In the inkjet printer 10, since the heating block 70 heats the ink at a higher temperature than the heating block 80, in case of heating the ink to a specific temperature, that is, to 50° C. by the entirety of the out-of-head ink heating device 68, a length of the heating block 70 along the ink supply passage to the inkjet head 40 can be made shorter as compared to the configuration that heats the ink to the same temperature by the heating block 70 and the heating block 80. Accordingly, as compared to the configuration that heats the ink to the same temperature by the heating block 70 and the heating block 80, the inkjet printer 10 can make the out-of-head ink heating device 68 more compact.

Further, in the inkjet printer 10, since the heating block 70 heats the ink at a higher temperature than the heating block 80, even if the ink is somewhat cooled at a portion between the heating block 70 and the heating block 80, such as at a portion of the connectors 63 and the like, ink that is already sufficiently warm can be warmed up by the heating block 80.

It should be noted that, in the inkjet printer 10, the heating block 70 may be configured to heat the ink at a same temperature as the heating block 80.

Further, in the inkjet printer 10, the temperature of the ink heated by the entirety of the out-of-head ink heating device 68 and the temperature of the ink heated by the inkjet head 40 are at the same temperature, that is, 50° C. This is because, in the inkjet printer 10, not only in a case where the temperature of the ink heated by the entirety of the out-of-head ink heating device 68 is lower than the temperature of the ink heated by the inkjet head 40, but also in a case of being higher as well, the unevenness in temperature depending on the locations is generated in the ink inside the inkjet head 40. However, the inkjet printer 10 may have some difference in the temperature of the ink heated by the entirety of the out-of-head ink heating device 68 and the temperature of the ink heated by the inkjet head 40.

It should be noted that, in inkjet printer 10, in the present embodiment, a set temperature of the ink heated by the heating block 70 is 55° C., and a set temperature of the ink heated by the heating block 80 and the inkjet head 40 is 50° C. However, the set temperatures of the ink to be heated by the heating block 70, the heating block 80, and the inkjet head 40 may suitably be determined respectively, for example, according to the property and the like of the ink that is to be actually used.

The inkjet printer 10 has the heating block 70 and the heating block 80 configured as separate components, and the ink supply passage to the inkjet head 40 is divided by the connectors 63 arranged between the heating block 70 and the heating block 80, so that the replacement of the inkjet head 40 can be performed easily.

Figure 8:
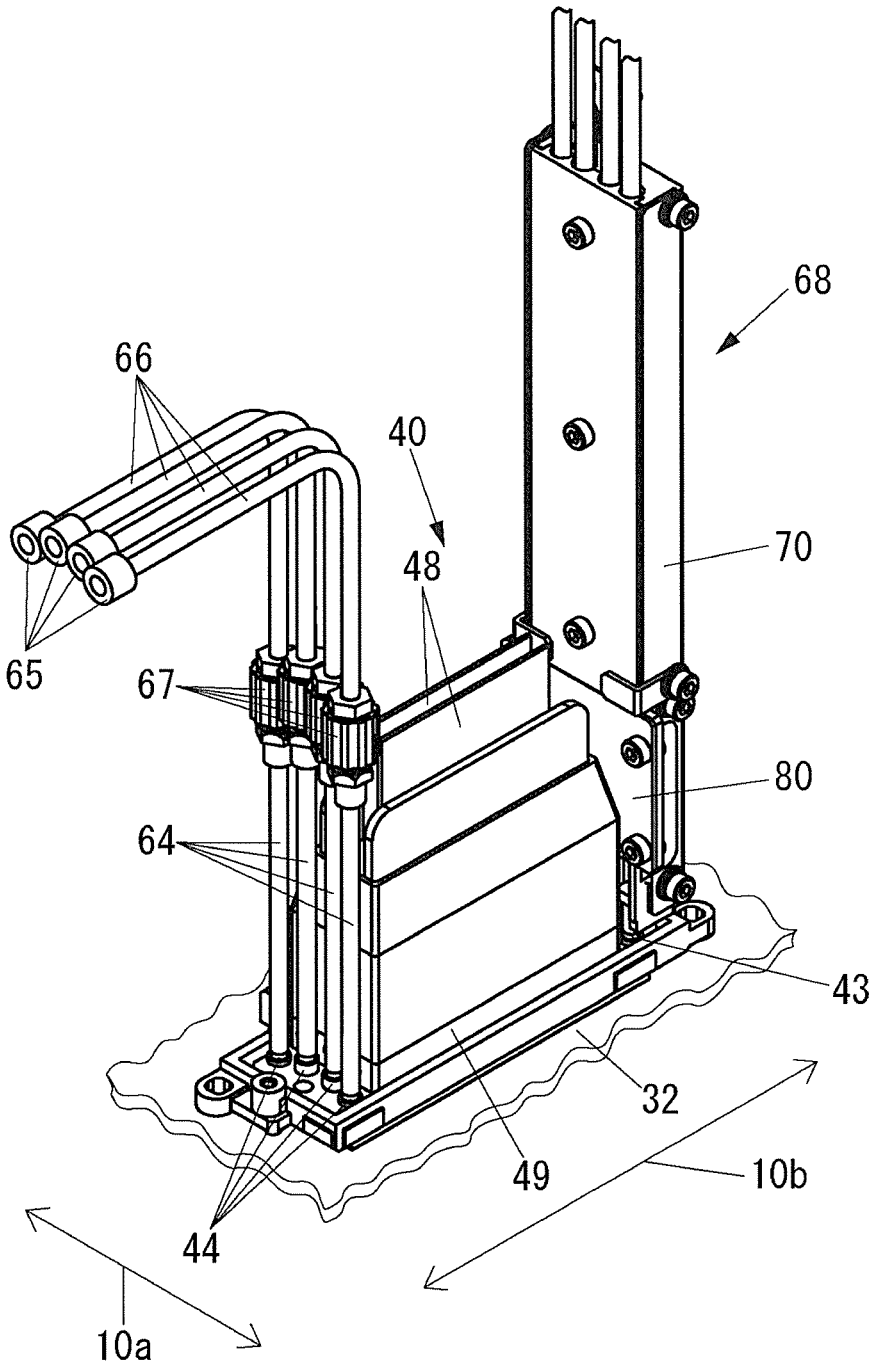
FIG. 8 is a perspective view of a vicinity of the inkjet head shown in FIG. 1, in an example in which the out-of-head ink heating device is different from the example shown in FIG. 4.

It should be noted that, in the inkjet printer 10, in the present embodiment, the heating block 70 and the heating block 80 are configured as separate components. However, in the inkjet printer 10, the connectors 63 may not be provided, and as shown in FIG. 8, an out-of-head ink heating device 68 in which the heating block 70 and the heating block 80 are integrated may be provided.

In the inkjet printer 10, in the present embodiment, the inkjet heads 40 are configured to be relatively moved in the sub scanning direction relative to the print medium 90 by moving the inkjet heads 40 in the sub scanning direction shown by the arrow 10*b*, however, it may have a configuration other than the above configuration. For example, the inkjet printer 10 may be configured to relatively move the inkjet head 40 in the sub scanning direction relative to the print medium 90 by conveying the print medium 90 in the sub scanning direction.

In the present embodiment, the inkjet printer 10 uses an ultraviolet curing type of ink as its ink, however, ink other than the ultraviolet curing type of ink may be used.

Second Embodiment

Firstly, a configuration of an inkjet printer according to a second embodiment of the present disclosure will be described.

Among the configurations of the inkjet printer according to the present embodiment, configurations identical to the configuration of the inkjet printer 10 of the first embodiment (see FIG. 1) will be given the same reference signs as the inkjet printer 10, and the detailed description thereof will be omitted.

Figure 9:
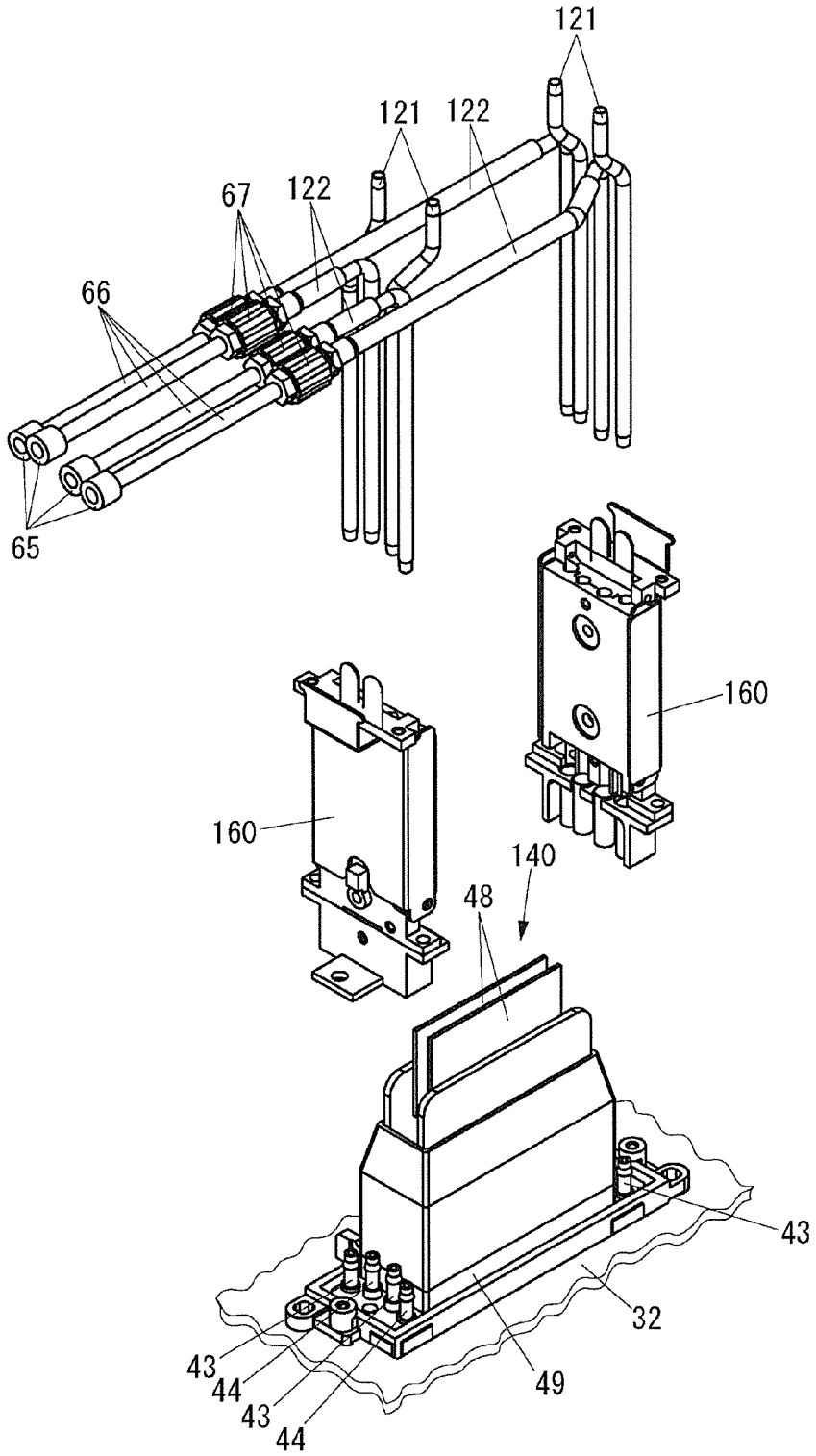
FIG. 9 is an exploded perspective view of the vicinity of the inkjet head in a state where the inkjet head of the inkjet printer according to the second embodiment of the present disclosure is mounted on the carriage.

FIG. 9 is an exploded perspective view of the vicinity of an inkjet head 140 in a state where the inkjet head 140 of the inkjet printer according to the present embodiment is mounted on the carriage 32.

As shown in FIG. 9, the configuration of the inkjet printer according to the present embodiment is similar to that of the inkjet printer 10 having stainless steel tubes 121 communicating with the ink supplying portions 43, stainless steel tubes 122 communicating with the ink ejecting portions 44, an inkjet head 140, and an out-of-head ink heating device 160 that heats ink on an ink supply passage to the inkjet head 140 at outside of the inkjet head 140, instead of the tubes 62 (see FIG. 4), the tubes 64 see FIG. 4), the inkjet heads 40 (see FIG. 4), and the out-of-head ink heating device 68 (see FIG. 4).

Figure 10:
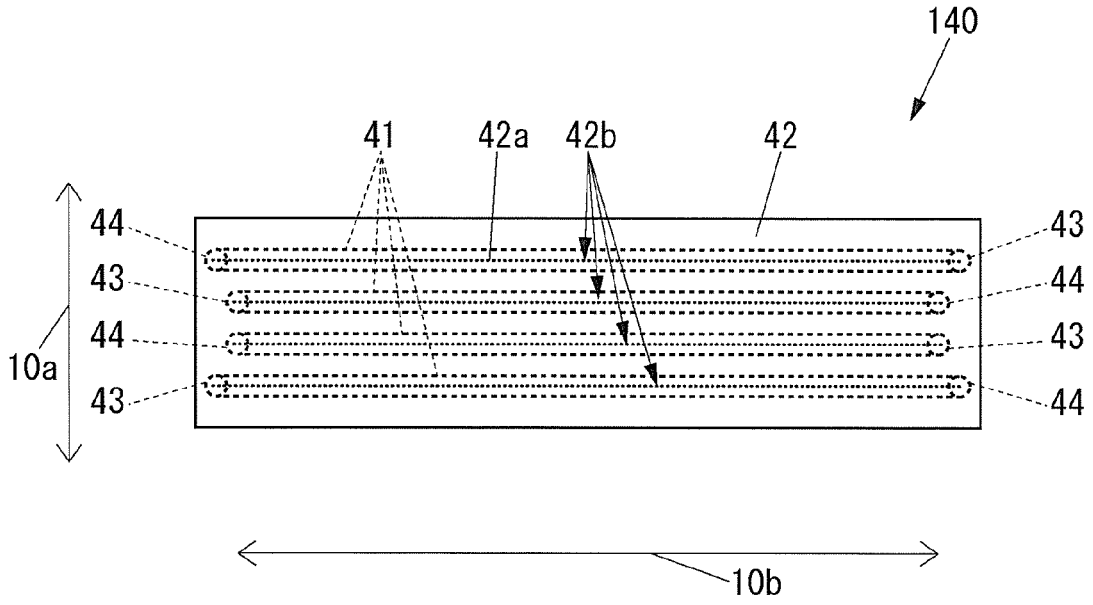
FIG. 10 is a schematic bottom surface diagram of the inkjet head shown in FIG. 9.

FIG. 10 is a schematic bottom surface diagram of the inkjet head 140.

A configuration of the inkjet head 140 is similar to the configuration of the inkjet head 40 except for the following configurations. As shown in FIG. 2 and FIG. 3, the inkjet heads 40 has four ink supplying portions 43 (in FIG. 2, only one of them is shown due to the viewpoint thereof. Further, in FIG. 3, only two of them are shown in connection to the cross section thereof) arranged on the same side as the nozzle rows 42*b* in the extending direction of the nozzle rows 42*b*, that is, in the sub scanning direction shown by the arrow 10*b*, and four ink ejecting portions 44 are arranged on the same side as the nozzle rows 42*b* in the sub scanning direction, that is, on an opposite side from the ink supplying portions 43. On the other hand, as shown in FIG. 10, the inkjet head 140 has the ink supplying portions 43 for supplying ink to nozzle rows 42*b* that are adjacent one another arranged on different sides from one another with respect to the nozzle rows 42*b* in the sub scanning direction, and the ink ejecting portions 44 that communicate with the nozzle rows 42*b* that are adjacent one another are arranged on different sides from one another with respect to the nozzle rows 42*b* in the sub scanning direction.

Figure 11:
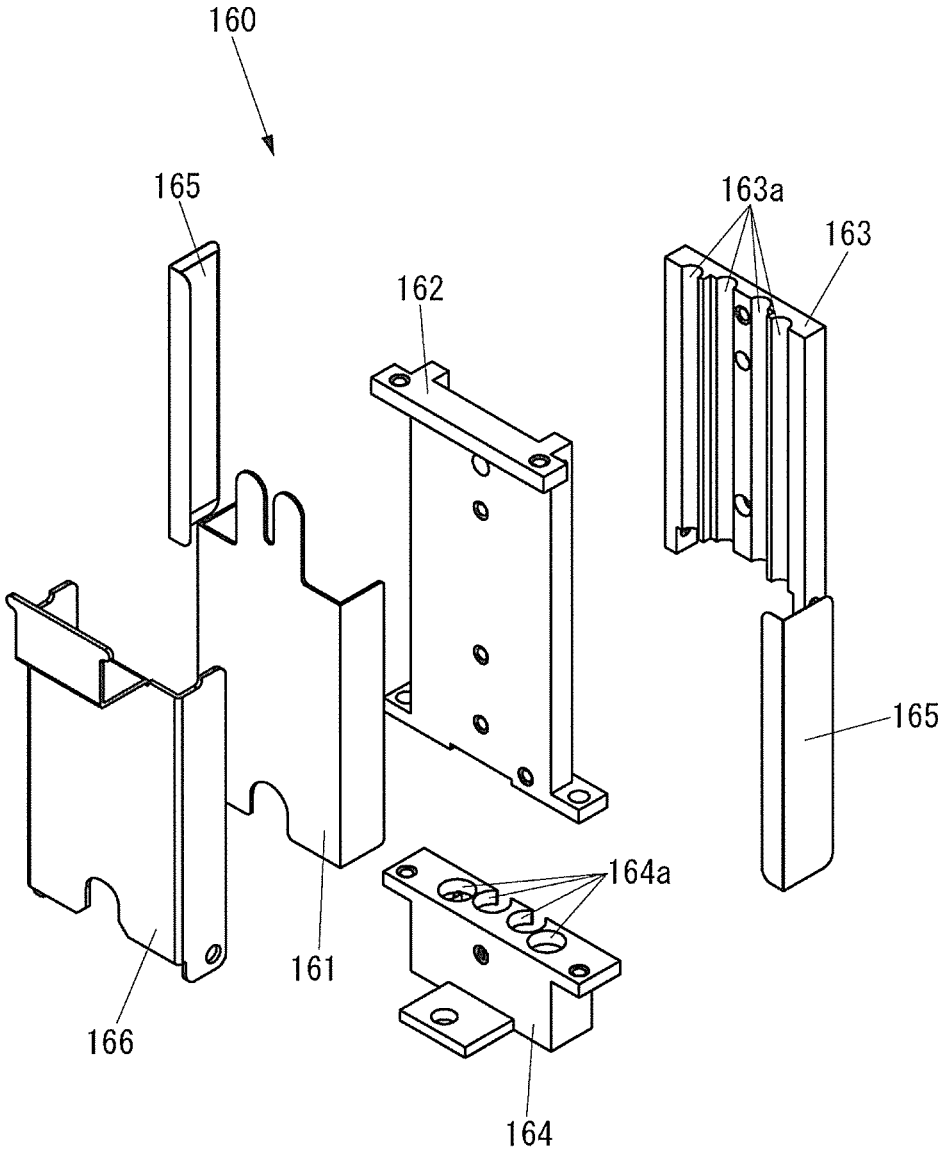
FIG. 11 is an exploded perspective view of an out-of-head ink heating device shown in FIG. 9.

FIG. 11 is an exploded perspective view of an out-of-head ink heating device 160.

As shown in FIG. 11, the out-of-head ink heating device 160 includes a heater 161 for heating the ink in the tubes 121 (see FIG. 9) and the tubes 122 (see FIG. 9), a heater base 162 in which grooves (not shown) for the tubes 121 and the tubes 122 to fit in are formed and that is heated by the heater 161 and for example is formed of aluminum, a heater base 163 in which grooves 163*a* for the tubes 121 and the tubes 122 to fit in are formed and that is used for fixing the tubes 121 and the tubes 122 by sandwiching them with the heater base 162 and for example is formed of aluminum, a heater base 164 in which holes 164*a* for the tubes 121 and the tubes 122 to be inserted are formed and that is for example formed of aluminum, protective films 165 that protect the heater 161, a presser plate 166 for fixing the heater 161 to the heater base 162, screws (not shown) for fixing the respective components to each other, a temperature sensor (not shown) for detecting a temperature of the ink in the tubes 121, and a temperature fuse (not shown).

As described above, in the inkjet printer of the present embodiment, as compared to the configuration in which all of the ink supplying portions 43 of the inkjet head 40 are arranged on the same side in the extending direction of the nozzle rows 42*b* with respect to the nozzle rows 42*b* as in the inkjet printer 10 according to the first embodiment, the locations within the inkjet head 140 where the ink heated by the out-of-head ink heating device 160 is to be supplied can be dispersed within the inkjet head 140 since some of the plurality of ink supplying portions 43 of the inkjet head 140 are arranged on a different side with respect to the nozzle rows 42*b* in the extending direction of the nozzle rows 42*b*. Due to this, the inkjet printer according to the present embodiment can suppress the generation of the unevenness in temperature in the ink inside the inkjet head 140 depending on the locations, so that the ink droplet discharging accuracy becoming different for each of the nozzles 42*a* of the inkjet head 140 due to the unevenness in viscosity in the ink inside the inkjet head 140 can be suppressed. Accordingly, the inkjet printer according to the present embodiment can improve the image quality of printing.

Especially, the inkjet printer according to the present embodiment has the ink supplying portions 43 supplying ink to the nozzle rows 42*b* adjacent to one another arranged on different sides with respect to the nozzle rows 42*b* in the sub scanning direction shown by the arrow 10*b*, so that the locations where the ink heated by the out-of-head ink heating device 160 is to be supplied within the inkjet head 140 can be dispersed finely within the inkjet head 140. Accordingly, the inkjet printer according to the present embodiment can especially improve the image quality of printing. However, the inkjet printer according to the present embodiment does not have to be configured to have the ink supplying portions 43 for supplying ink to nozzle rows 42*b* that are adjacent one another arranged on the different sides from one another with respect to the nozzle rows 42*b* in the sub scanning direction shown by the arrow 10*b*, so long as the plurality of ink supplying portions 43 of the inkjet head 140 includes those arranged on the different sides with respect to the nozzle rows 42*b* in the sub scanning direction.

It should be noted that, the inkjet printer according to the present embodiment does not have the out-of-head ink heating device 160 configured by the plurality of heating blocks as in the out-of-head ink heating device 68 (see FIG. 4), however, it may be configured of such a plurality of heating blocks. Further, the out-of-head ink heating device 160 may be configured to heat ink at different temperatures depending on locations, as in the out-of-head ink heating device 68.

What is claimed is:

1. An inkjet printer, comprising:

an inkjet head that discharges ink droplets toward a print medium;

an in-head ink heating unit that heats ink inside the inkjet head; and an out-of-head ink heating device that heats ink in an ink supply passage to the inkjet head at outside of the inkjet head, wherein the out-of-head ink heating device is arranged at a position where the heated ink is supplied to the inkjet head, a plurality of nozzle rows is formed in the inkjet head, the nozzle rows including nozzles that discharge ink droplets aligned in plurality, the inkjet head includes a plurality of ink supplying portions for the ink heated by the out-of-head ink heating device which is to be supplied for each of the nozzle rows, a plurality of ink passages and a plurality of ink ejecting portions, wherein each ink passage is provided with only one of the ink supplying portions and only one of the ink ejecting portions, the only one ink supplying portion is connected to one end of the ink passage, and the only one ink ejecting portion is connected to the other end of the ink passage, the plurality of nozzle rows is arranged in a direction vertically intersecting an extending direction of the nozzle rows, the plurality of ink supplying portions of the inkjet head includes ones arranged on different sides in the extending direction with respect to the nozzle rows, the out-of-head ink heating device is disposed to respectively heat the plurality of ink supplying portions arranged on different sides in the extending direction with respect to the nozzle rows, and the ink flows into each ink passage of the inkjet head through the corresponding ink supplying portion and flows out through the corresponding ink ejecting portion.

2. The inkjet printer according to claim 1, wherein the out-of-head ink heating device includes:

a former heating unit that heats ink; and a latter heating unit arranged on the supply passage at a position to heat ink between the former heating unit and the inkjet head, wherein the former heating unit heats the ink at a higher temperature than the latter heating unit.

3. The inkjet printer according to claim 2, further comprising:

a connector for dividing the supply passage between the former heating unit and the latter heating unit, wherein the out-of-head ink heating device is configured with the former heating unit and the latter heating unit being different components.

4. The inkjet printer according to claim 1, wherein the ink supplying portions that supply ink to the nozzle rows that are adjacent to each other are arranged on different sides from each other in the extending direction with respect to the nozzle rows.

5. The inkjet printer according to claim 1, wherein one ink supplying portion is disposed in one nozzle row.

6. The inkjet printer according to claim 1, wherein one ink passage, one nozzle row, the ink supplying portion connected to the one ink passage, and the ink ejecting portion connected to the one ink passage are communicated with each other.

* * * * *